US010470566B1

(12) United States Patent
Rabbany et al.

(10) Patent No.: US 10,470,566 B1
(45) Date of Patent: Nov. 12, 2019

(54) SHELVING SYSTEM

(71) Applicants: Farhad Rabbany, Beverly Hills, CA (US); Faramarz Yadegari, Beverly Hills, CA (US)

(72) Inventors: Farhad Rabbany, Beverly Hills, CA (US); Faramarz Yadegari, Beverly Hills, CA (US)

( * ) Notice: Subject to any disclaimer, the term of this patent is extended or adjusted under 35 U.S.C. 154(b) by 0 days.

(21) Appl. No.: 15/989,007

(22) Filed: May 24, 2018

(51) Int. Cl.

| | |
|---|---|
| ***A47B 46/00*** | (2006.01) |
| ***A47B 47/02*** | (2006.01) |
| ***A47B 96/07*** | (2006.01) |
| ***A47B 96/06*** | (2006.01) |

(52) U.S. Cl.
CPC ..... *A47B 46/005* (2013.01); *A47B 47/021* (2013.01); *A47B 96/066* (2013.01); *A47B 96/068* (2013.01); *A47B 96/07* (2013.01)

(58) Field of Classification Search
CPC ..... A47B 46/005; A47B 47/021; A47B 43/00; A47B 57/04; A47B 57/045; A47B 47/022; A47B 96/027; A47B 96/02; A47B 46/00; A47B 96/06; A47B 96/061; A47B 96/066; A47B 96/068; A47B 96/07; A47F 5/10; A47F 5/0037; A47F 5/12; A47F 5/16; Y10T 403/32861; Y10T 403/32868; Y10T 403/32877; Y10T 403/32918
USPC ..... 211/149, 150, 90.02, 182; 108/6, 108/99–101, 115; 403/150, 151, 152, 403/157; 248/235, 239, 241, 242
See application file for complete search history.

(56) References Cited

U.S. PATENT DOCUMENTS

| | | | | |
|---|---|---|---|---|
| 530,349 | A | 12/1894 | Payne | |
| 722,760 | A | 3/1903 | Scarborough | |
| 915,618 | A * | 3/1909 | Mattison | A47B 43/02 108/179 |
| 1,402,929 | A | 1/1922 | Herpst et al. | |
| 2,445,164 | A | 7/1948 | Worthman | |
| 2,758,724 | A | 8/1956 | Schneider | |
| 3,045,831 | A | 7/1962 | Pendergrast, Jr. et al. | |
| 3,137,251 | A | 6/1964 | Pendergrast, Jr. | |
| 3,151,576 | A | 10/1964 | Patterson | |
| 3,235,096 | A | 2/1966 | Hallock et al. | |
| 3,295,471 | A | 1/1967 | Cook | |
| 3,527,360 | A | 9/1970 | Thielking | |
| 3,570,679 | A | 3/1971 | Edson | |
| 3,845,727 | A | 11/1974 | Chase | |
| 3,908,562 | A * | 9/1975 | Wittschen | A47F 5/135 108/163 |
| 3,977,689 | A * | 8/1976 | Rosa | B62B 3/025 280/33.996 |
| 4,151,803 | A | 5/1979 | Ferrera et al. | |
| 4,278,224 | A * | 7/1981 | Arakawa | A47B 43/006 248/246 |
| 4,582,003 | A | 4/1986 | Valero | |

(Continued)

*Primary Examiner* — Jennifer E. Novosad
(74) *Attorney, Agent, or Firm* — Fulwider Patton LLP

(57) ABSTRACT

A collapsible shelving assembly with back posts and front posts has one or more shelves attached by hinges to the back posts so that each shelf is configured to rotate about the hinges from an upward collapsed condition to a downward horizontal deployed condition. The fronts post include clips configured to secure the front end of each shelf in the horizontal deployed condition. A friction plug is incorporated into each hinge to slow the speed of rotation and to prevent the shelves from freely falling downwards during assembly.

8 Claims, 6 Drawing Sheets

(56) References Cited

U.S. PATENT DOCUMENTS 4,646,922 A 3/1987 Smith
4,688,681 A 8/1987 Bergeron
4,760,928 A 8/1988 Bustos
4,788,748 A 12/1988 Bizek
4,929,113 A * 5/1990 Sheu ..... F16C 11/045 403/157
5,125,517 A * 6/1992 Martinell ..... B62H 3/12 211/17
5,154,382 A * 10/1992 Hoshino ..... F16C 11/103 248/185.1
D336,725 S 6/1993 Emanuel
5,277,427 A * 1/1994 Bryan ..... A63B 69/3632 403/157
5,592,887 A * 1/1997 Teng ..... A47B 21/00 108/134
5,738,230 A * 4/1998 Goldstein ..... A47B 43/00 211/149
5,816,419 A 10/1998 Lamson
5,826,732 A 10/1998 Ragsdale
5,842,808 A * 12/1998 Potter ..... A63B 69/3632 403/27
5,882,098 A 3/1999 Brown et al.
5,884,647 A * 3/1999 Dwek ..... E04H 15/52 135/144
5,899,346 A * 5/1999 Newkirk ..... A47B 43/00 108/176
6,302,282 B1 10/2001 Gay et al.
6,457,737 B1 10/2002 King
6,675,546 B2 * 1/2004 Coles ..... F16B 7/185 403/157
7,040,589 B2 * 5/2006 Wang ..... A47G 25/0685 248/242
7,614,413 B1 * 11/2009 Ma ..... A45B 25/02 135/29
7,832,571 B2 * 11/2010 Felsenthal ..... A47B 47/027 211/134
8,919,715 B2 * 12/2014 Terada ..... A47B 96/028 108/115
9,901,169 B1 * 2/2018 Schenker ..... A47B 43/00
10,066,783 B2 * 9/2018 Shen ..... F16M 13/022
2003/0057171 A1 * 3/2003 Wang ..... A47B 43/00 211/195
2009/0038119 A1 2/2009 Rude et al.
2010/0116764 A1 * 5/2010 Lin ..... A47B 43/00 211/149
2010/0122964 A1 * 5/2010 Lin ..... A47B 43/00 211/149
2010/0200525 A1 * 8/2010 Keyvanloo ..... A47B 96/07 211/59.2
2011/0011816 A1 * 1/2011 Marietta ..... A47B 43/00 211/149
2011/0012490 A1 * 1/2011 Schwendemann ... A47B 46/005 312/326
2011/0031200 A1 * 2/2011 Chen ..... A47B 43/00 211/149

* cited by examiner

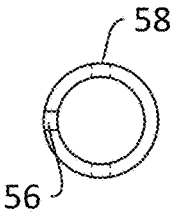
FIG. 9
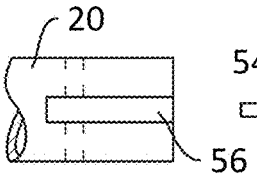
FIG. 8
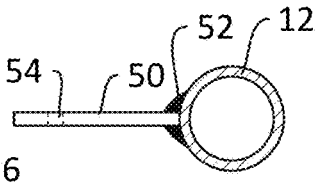
FIG. 5
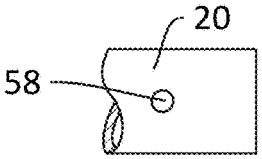
FIG. 7
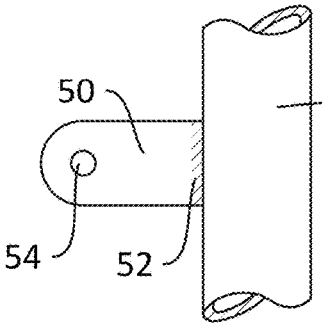
FIG. 4
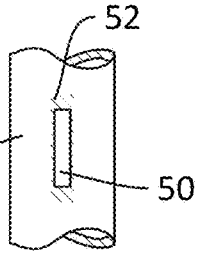
FIG. 6
FIG. 11
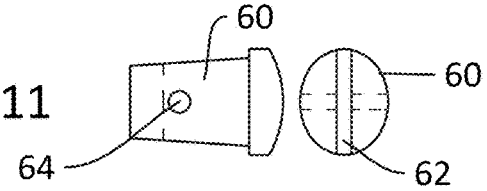
FIG. 12
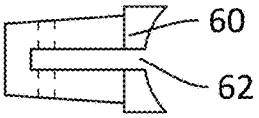
FIG. 10

SHELVING SYSTEM

BACKGROUND

The present invention relates to the broad field of collapsible shelving, and more particularly to those forms of shelving that are collapsible into a generally planar configuration for packaging and shipping.

It is known in the art of shelving and furniture manufacture how to engage the various part of a shelf or furniture unit to facilitate rapid assembly after purchase when the shelving or furniture has been shipped in a package. In some cases, assembly is carried out by using screws or other fasteners to connect the various components together. In other cases, assembly may be carried out by allowing the components to be folded out on hinges, and to rotate on axes, so that a minimum of screws and other loose fasteners need be used to hold the unit together after being unpacked and assembled.

However, a problem exists in the art, because the hinges that are presently provided in units of this kind tend to suffer from the fact that a person assembling the furniture is unable to control the ease and speed at which the hinges may rotate. When there are multiple hinges that must be rotated to place the unit in a usable condition, it is often difficult for the assembler to simultaneously control all of the hinges, and this has the effect of leaving the assembler struggling to align all the elements of the unit correctly for assembly.

The present invention addresses these and other needs.

SUMMARY OF THE INVENTION

In one embodiment, the invention is a shelving assembly comprising a first back post extending vertically and aligned along a first vertical axis, and a second back post extending vertically and aligned along a second vertical axis. A first front post extends vertically and a second front post extending vertically. At least one shelf is attached by a first hinge to the first back post and by a second hinge to the second back post. Under this configuration, each of the at least one shelf is configured to rotate about the first hinge and the second hinge from an upward collapsed condition to a downward horizontal deployed condition. Further, the first front post includes a first clip configured to support the first shelf in the horizontal deployed condition. and the second front post includes a second clip configured to support the first shelf in the horizontal deployed condition.

In some embodiments, the first hinge comprises a blade attached to and extending horizontally from the first back post. An end tube portion of the first shelf is positioned over the blade. An axle pin extends through the blade and through the end tube portion. A friction plug is positioned inside the end tube portion and surrounding the blade.

In some embodiments, the friction plug includes a slot extending from a first end of the plug toward a second end, wherein the slot terminates short of the second end. In other embodiments, the friction plug is formed from a polymer. In yet other embodiments, the first end of the friction plug has an arcuate shape conforming to the outer surface of the first back post. In some embodiments, the friction plug has a tapered cylindrical shape, and in similar embodiments, the first end of the friction plug has an enlarged outer diameter disposed between the end tube portion and the first back post. In some embodiments, the first front post is rotatable about the first vertical axis, and the second front rod is rotatable about the second vertical axis. In a further embodiment, a lower portion of each front and back post is detachable from an upper position of each front and back post.

These and further advantages of the invention will be understood when read in conjunction with the drawings herein, and the detailed description of some embodiments.

BRIEF DESCRIPTION OF THE DRAWINGS

FIG. 4 is a detail fragmentary side elevational view of a portion of the hinge used in the present invention.

FIG. 5 is a top view of the detail shown in FIG. 4.

FIG. 6 is a front view of the detail shown in FIG. 4.

FIG. 7 is a detail side elevational view of another portion of the hinge configured to join with the portion shown in FIG. 4.

FIG. 8 is a top view of the component shown in FIG. 7.

FIG. 9 is a proximal end view of the component shown in FIG. 7.

FIG. 10 is a detail top view of a friction component for the hinge configured to fit between the components shown in FIGS. 4 and 7.

FIG. 11 is a side elevational view of the friction component shown in FIG. 10.

FIG. 12 is a proximal end view of the friction component shown in FIG. 10.

DETAILED DESCRIPTION OF THE PREFERRED EMBODIMENTS

Figure 1:
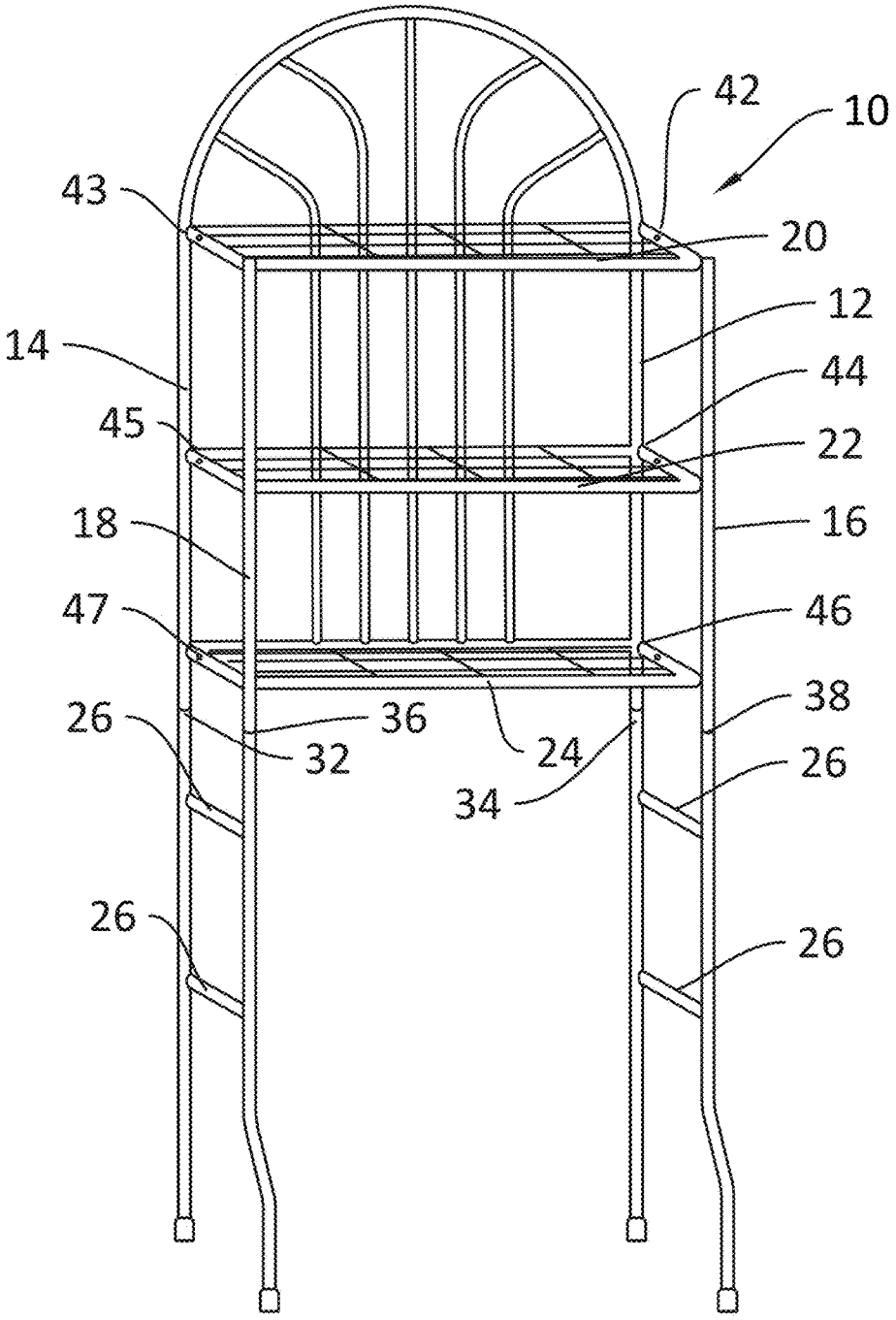
FIG. 1 shows a perspective view of a shelving unit incorporating features of the present invention, in a fully assembled condition.

FIG. 1 shows an example of a shelving unit 10 suitable for use with the present invention. The unit is lightweight and may be made, for example, from an assembly of hollow metal tubes. While the shelving unit 10 depicted in FIG. 1 is especially adapted for use in a bathroom, it will be apparent to those skilled in the art that the present invention also can be used for other types of shelving including shoe racks and other shelves intended for use in a domestic setting.

The shelving 10 comprises a pair of back posts 12, 14 extending vertically and parallel with each other, with one end of each post designed to rest on a floor. A pair of front posts 16, 18 also extend vertically and parallel with each other and with the back posts, with one end of each front post also designed to rest on the floor. These four posts provide the corners of a shelving structure having four vertical and generally rectangular sides: back side, front side, left side and right side.

Extending from the two back posts 12, 14 is a first shelf 20 which, in a deployed and fully assembled condition of the shelving unit 10, extends forwardly to provide an upper horizontal shelf. As best seen in FIG. 1, the first shelf 20 is connected to the back posts at two hinge points 42 and 43.

Figure 2:
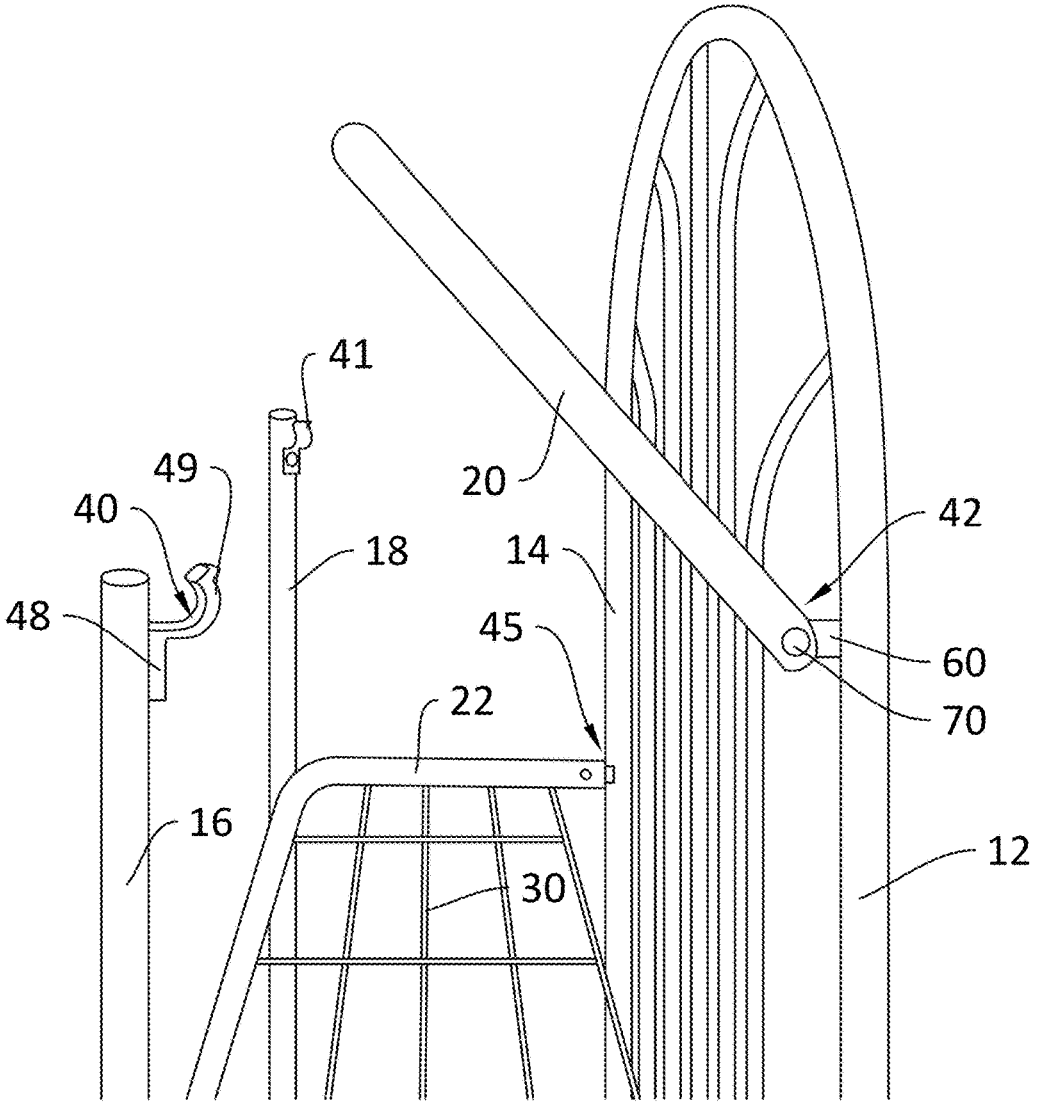
FIG. 2 is an enlarged detail side view of the upper portion of the shelving unit shown in FIG. 1, with the upper shelf in a partially folded condition.
Figure 3:
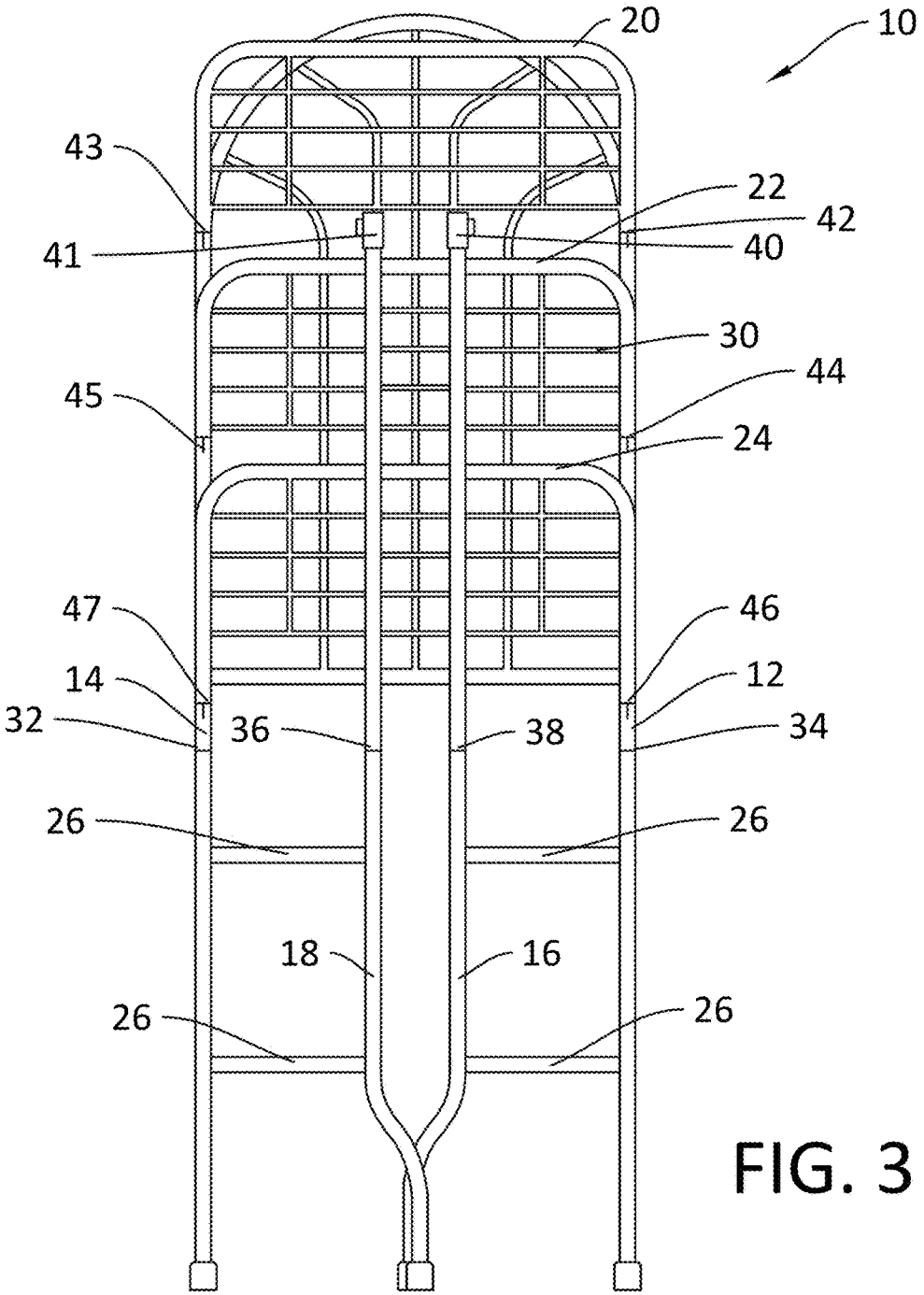
FIG. 3 is a front elevational view of the shelving unit shown in FIG. 1, in a collapsed condition suitable for shipping.

As seen in FIG. 2, the hinge 42 attaches one side of the first shelf 20 to one of the back posts 12. (Hinge 43 is not visible in FIG. 2 but it attaches the opposite side of the shelf 20 to the other back post 14 in a similar manner). The hinges 42, 43 permit the shelf 20 to be rotated upwards, until it is extending vertically, as seen in FIG. 3. Upon being rotated downwards (as shown in FIG. 1), the first shelf 20 attaches to the front posts 16, 18 via two clips 40, 41 attached to the posts 16, 18, respectively, as best shown in FIG. 2. Each clip 40, 41 preferably has a base 48 mounted on the post and a resilient support arm 49 extending from the base that partially surrounds and engages a tube 21 that defines the perimeter of the shelf 20. The arm 49 engages the tube 21 with a snap fit to hold the shelf in place when the shelf 20 is in the downward (fully deployed) position.

A second shelf 22 attaches to the two back posts 12, 14 at two hinge points 44, 45 and a third shelf 24 attaches to the two back posts 12, 14 at two hinge points 46, 47. The three shelves 20, 22, 24 are stacked vertically one above or below the other. The second 22 and third 24 shelves may also be rotated upwardly, as seen in FIG. 3, just as the first shelf 20. When all the shelves are folded upwardly as shown in FIG. 3, which depicts the collapsed condition, the shelving system 10 becomes generally a planar structure having a depth that is substantially smaller than the shelf system shown in FIG. 1, in the deployed condition.

Below the shelves 20, 22, 24, the back posts 12, 14 are connected to the front posts 16, 18 by a plurality of cross members 26, as shown in FIG. 1. In between the uppermost cross member 26 and the lowest shelf 24, each of the two back posts is provided with a rotatable axle at 32, 34, which allows the front posts 16, 18 to be rotated inward, towards the center of the shelving unit 10 as seen in FIG. 3. This rotation places the shelving unit in the compact condition of FIG. 3, which is suitable for packing in a flat cardboard shipping box. In a preferred embodiment, the upper and lower portions of the front and back posts also can be separated from each other just below the lowermost shelf, so that the lower portions, once separated, can be stacked on top of the folded upper portions within the shipping container, for an even more compact arrangement.

Figure 3A:
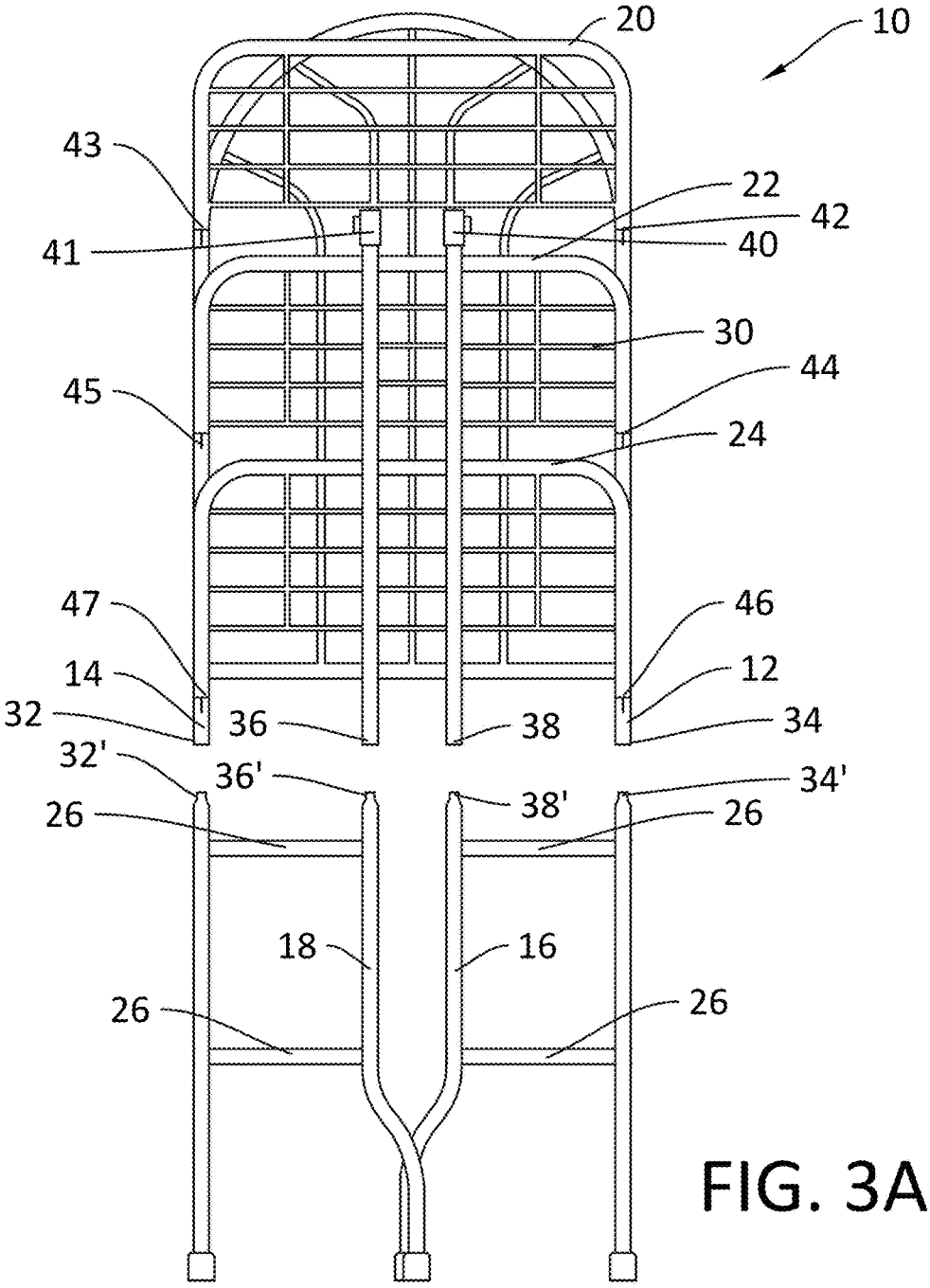
FIG. 3A is a front elevational view of the shelving unit shown in FIG. 3, in a separated condition, suitable for more compact shipping.

More specifically, an aspect of the axles 32,34 which permit rotation is that they may also permit the back posts 12, 14 to separate into two pieces in a telescoping action. Further, telescoping axles 36, 38 may be provided on the front posts 16, 18 as well, allowing the front posts to also separate into two pieces at the location of the axles 36, 38. Thus, the provision of these four axles 32, 34, 36, 38 permits the back posts and the front posts to separate into upper and lower portions as shown in FIG. 3A, permitting for a more compact packaging configuration because the lower portion of the back posts and front posts may be lain over the upper portions in the packaging container. To facilitate assembly, the uppermost ends of the tubular lower portions 32', 34', 36' and 38' may be tapered to telescopingly fit within the lowermost ends of the tubular upper portions 32, 34, 36, 38 with a sufficiently snug inference fit to prevent the lowermost portions from unintentionally separating from the uppermost portions when the shelfing unit 10 is lifted off the floor.

When a customer purchases the shelving unit 10 in the shipping box, he then proceeds to assemble it by reversing the steps described above. This will entail rotating the front posts 16, 18 to a lateral condition as shown in FIG. 1. Then, the first shelf 20 of the three shelves will be rotated downwardly (FIG. 2) from its upward storage condition until it is caught and suspended by the clips 40, 41.

A problem that can arise is that before the assembler can gain control of the shelving unit, the first shelf 20, the second shelf 22, and third shelf 24 tend to freely fall downwards (also as in FIG. 2), making it difficult for the assembler to control all the moving pieces. In embodiments where there are more shelves, the problem can become even more unmanageable.

In order to solve this problem, the shelving unit 10 includes a hinge insert, or hinge plug, specially adapted to dampen and slow down the speed of rotation of the hinges. The hinge plug and its operation is best understood by reference to FIGS. 4-13.

FIGS. 4-6 show, in orthogonal views, a first component of one of the hinges (for example hinge 42) into which the hinge plug will be inserted. The hinge comprises a flat blade 50 which is welded 52 onto an external surface of the first vertical post 21 to project horizontally forward. A circular hole 54 is formed through the blade 50, for receiving a pin axle 70 (pin not shown in FIGS. 4-12, but shown in FIGS. 2 and 13). FIGS. 7-9 show a second component of the hinge, in orthogonal views. A rear end portion of the shelf tube 21 is prepared by cutting a slot 56 (best seen in FIG. 8) through only the top surface of the tube 21. A circular hole 58 is formed to extend transversely and horizontally through the walls of the tube 21, and sized to permit the pin axle 70 to pass through it. The slotted end portion of the shelf tube 21 then fits over the blade 50 until the holes 54 and 58 are aligned. The pin axle 70 then passes through the hole 54 in the blade 50 and through the hole 58 in the tube 21 to secure the components 50 and 21 together. The slot 56 permits the shelf 21 to be rotated upwardly, so that the blade 50 effectively passes through the slot 56 of the moving shelf tube 21. On the way downward, the tube cannot pass beyond the horizontal, because the bottom surface of the shelf tube 21 has not been cut to form a slot, and the tube 21 is this restrained from moving downwards beyond the horizontal by the bottom edge of the blade 50. This may be best seen with reference to FIG. 13, which shows the first vertical post 12 connected to the shelf 20 via the blade 50.

Figure 13:
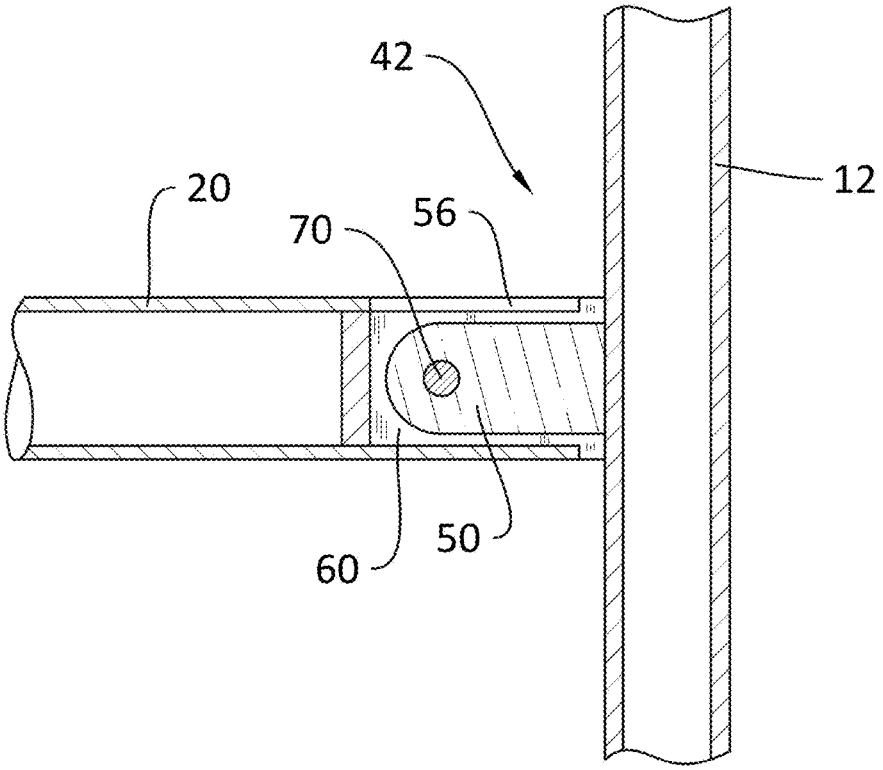
FIG. 13 is an enlarged sectional view of the assembled hinge components shown in FIGS. 4, 7 and 10.

The hinge plug 60 is shown in FIGS. 10-12 as a separate item, and is shown in FIG. 13 in the assembled condition. The hinge plug takes the form of a tapered cylinder, sized to fit snugly into the proximal end portion of the shelf tube 21. The plug 60 is preferably formed of a resilient polymer, suitable to receive wear without degradation. A planar slot 62 is cut downwards along a vertical diameter of the plug 60. The slot 62 does not extend along the entire length of the plug, but a short distance at the distal end is left uncut (as shown in FIG. 10) to allow the plug to remain as a single unit and not fall into two pieces. This makes the plug 60 more easily manageable for insertion into the end of the tube 21. The width of the slot is sized to receive the width of the blade 60. A hole 64 formed to extend horizontally across the width of the plug, is sized to receive the pin axle 70 which also passes through the hole 58 in the tube 21 and the hole 54 in the blade 50. The proximal end portion of the plug closest to the vertical post 12 preferably has an enlarged outer diameter which acts as a spacer between the tube 21 and the post 12, as best shown in FIG. 13. The proximal end surface 72 of the plug 60 preferably has a concave shape that conforms to the curved outer surface of the post 12 so that the end of the plug will sit closely against the post with no gaps or spaces when the components of the hinge are fully assembled.

The assembled hinge is shown in sectional view in FIG. 13. The plug 60 surrounds the blade 50, and is compressed into close engagement with the sides of the blade as the plug is forced into the end of the shelf tube 21 during manufacture. The tapered shape of the plug 60 allows it to be more easily inserted into the end of the tube 21 and to produce increased compression against the blade 50 as the plug is forced farther into the end of the tube 21. The pin axle 70 passes through the three holes 58, 54, and 64, and may take the form of a threaded bolt or a pop rivet. The bolt or rivet may be adjustably tensioned, if desired, to tension the pin axle 70 a suitable degree and thereby adjust the amount of force used to compress the plug 60 against the blade 58. Forcing the plug 60 to compress against the sides of the blade 50 applies additional friction to the blade as the blade rotates relative to the shelf tube 21, thereby slowing down the natural speed of rotation of the shelf 20. This makes the shelf more manageable during deployment and helps to prevent the shelf from falling unintentionally from the folded (upward) position to the deployed (downward) position during deployment.

The arrangement shown in FIG. 13 may be replicated in each of the hinges 42, 43, 44, 45, 46, 47, and any additional hinges that may be present in other embodiments. The introduction of hinge plugs 60 into each hinge has the advantageous effect of rendering the shelving system more manageable during assembly, allowing the assembler to gain better control of the system, and deploying all the components in an orderly fashion.

The present invention may, of course, be carried out in other specific ways than those herein set forth without departing from the essential characteristics of the invention. The present embodiments are, therefore, to be considered in all respects as illustrative and not restrictive, while the scope of the invention is set forth in the claims that follow.

We claim:

1. A shelving assembly comprising:

a first back post extending vertically and aligned along a first vertical axis, and a second back post extending vertically and aligned along a second vertical axis;

a first front post extending vertically and a second front post extending vertically;

at least one shelf attached by a first hinge to the first back post and by a second hinge to the second back post;

wherein each of the at least one shelf is configured to rotate about the first hinge and the second hinge from an upward collapsed condition to a downward horizontal deployed condition;

wherein the first front post includes a first clip configured to support the at least one shelf in the horizontal deployed condition, and the second front post includes a second clip configured to support the at least one shelf in the horizontal deployed condition; and wherein the first hinge comprises:

a blade attached to and extending horizontally from the first back post;

an end tube portion of the at least one shelf positioned over the blade;

an axle pin extending through the blade and through the end tube portion; and a friction plug inside the end tube portion and surrounding the blade.

2. The shelving assembly of claim 1, wherein the friction plug includes a slot extending from a first end of the plug toward a second end, wherein the slot terminates a distance from the second end.

3. The shelving assembly of claim 1, wherein the friction plug is formed from a polymer.

4. The shelving assembly of claim 1, wherein the first end of the friction plug has an arcuate shape conforming to an outer surface of the first back post.

5. The shelving assembly of claim 1, wherein the friction plug has a tapered cylindrical shape.

6. The shelving assembly of claim 1, wherein the first end of the friction plug has an enlarged outer diameter disposed between the end tube portion and the first back post.

7. The shelving assembly of claim 1, wherein the first front post is rotatable about the first vertical axis, and the second front post is rotatable about the second vertical axis.

8. The shelving assembly of claim 1, wherein a lower portion of each front and back post is detachable from an upper portion of each front and back post.

* * * * *